US012782084B2

(12) United States Patent
Nolte et al.

(10) Patent No.: US 12,782,084 B2
(45) Date of Patent: Nov. 3, 2026

(54) BUTTSTOCK FOR A FIREARM

(71) Applicant: Glock Technology GmbH, Ferlach (AT)

(72) Inventors: Patrick Nolte, Klagenfurt am Woerthersee (AT); Karl Markut, Klagenfurt am Woerthersee (AT)

(73) Assignee: Glock Technology GmbH (AT)

( * ) Notice: Subject to any disclaimer, the term of this patent is extended or adjusted under 35 U.S.C. 154(b) by 0 days.

(21) Appl. No.: 19/161,221

(22) PCT Filed: Feb. 29, 2024

(86) PCT No.: PCT/AT2024/060074
§ 371 (c)(1),
(2) Date: Aug. 29, 2025

(87) PCT Pub. No.: WO2024/178454
PCT Pub. Date: Sep. 6, 2024

(65) Prior Publication Data

US 2026/0243540 A1 Aug. 20, 2026

(30) Foreign Application Priority Data

Mar. 2, 2023 (EP) ..... 23159539

(51) Int. Cl.
*F41C 23/14* (2006.01)

(52) U.S. Cl.
CPC ..... *F41C 23/14* (2013.01)

(58) Field of Classification Search
CPC ..... F41C 23/00; F41C 23/04; F41C 23/14
See application file for complete search history.

(56) References Cited

U.S. PATENT DOCUMENTS 9,261,324 B1 * 2/2016 Liang ..... F41C 23/04
9,551,549 B1 * 1/2017 Chvala ..... F41C 7/00
10,139,195 B2 * 11/2018 Olsen ..... F41C 23/14
(Continued)

FOREIGN PATENT DOCUMENTS

KR 102141664 B1 8/2020
WO WO-2021245630 A1 * 12/2021 ..... F41C 23/14

OTHER PUBLICATIONS

English abstract for KR-102141664.
(Continued)

*Primary Examiner* — Benjamin P Lee
(74) *Attorney, Agent, or Firm* — Fishman Stewart PLLC

(57) ABSTRACT

A buttstock for a firearm. The buttstock includes a housing, a locking bolt, and an actuating lever. The housing includes a main housing part, a rear housing part, and a housing strut The main housing part has a sliding guide. A clearance is formed between the housing strut, the main housing part, and the rear housing part. There is locking bolt mount for mounting the locking bolt. The locking bolt is displaceable between a locking position, a displacing position, and an open position. The actuating lever has a cross pin mount and is fastened via a cross pin. The actuating lever has a first lever arm and a second lever arm. The first lever arm serves for displacing the locking bolt between the locking position, the displacing position, and the open position. The second lever arm has an actuating surface for actuation by a user.

20 Claims, 8 Drawing Sheets

(56) References Cited

U.S. PATENT DOCUMENTS

| | | | | |
|---|---|---|---|---|
| 11,740,050 | B2 * | 8/2023 | Alomaira | F41C 23/14<br>42/71.01 |
| 12,152,856 | B2 * | 11/2024 | Miller | F41C 23/04 |
| 12,578,164 | B2 * | 3/2026 | Miller | F41C 23/04 |
| 2013/0180148 | A1 * | 7/2013 | Rogers | F41C 23/04<br>42/73 |
| 2016/0209161 | A1 * | 7/2016 | Wilson | F41C 23/14 |
| 2018/0080736 | A1 * | 3/2018 | Olsen | F41C 23/14 |
| 2021/0381799 | A1 * | 12/2021 | Alomaira | F41C 23/14 |
| 2024/0077279 | A1 * | 3/2024 | Faifer | F41C 23/06 |
| 2025/0093127 | A1 * | 3/2025 | Palmer | F41C 23/04 |

OTHER PUBLICATIONS

"How to remove a Daniel Defense Buttstock" https://www.youtube.com/watch?v=38JOtrZR7lo. XP93068460.
ISR for PCT/AT2024/060074, dated Apr. 11, 2024.

* cited by examiner

BUTTSTOCK FOR A FIREARM

CROSS-REFERENCE TO RELATED APPLICATION

This application is a US National Phase Application of PCT/AT2024/060074, filed on Feb. 29, 2024, which claims priority to EP Application Serial No. 23159539.8, filed on Mar. 2, 2023, the contents of which are incorporated herein by reference in their entirety.

FIELD OF TECHNOLOGY

The disclosure relates to a buttstock for a firearm, for example, for a carbine, and also to a firearm fitted with the buttstock, as well as to a method for positioning the buttstock.

The firearm according to the disclosure may, for example, be a carbine, but it may also may, for example, be a semi-automatic or fully automatic rifle, a machine gun, a repeating rifle, a shotgun, some other rifle, a submachine gun, a pistol etc. Firearms are guns that can be carried and used by one person.

BACKGROUND

In It has already been known for quite some time that the buttstock on firearms, in particular carbines, can be adjusted to allow an adaptation to different users to be made. It is also known that the buttstock can be removed completely from a buttstock mount, such as for instance a buffer tube, of a receiver of the firearm for maintenance purposes.

A buttstock is shown in the YouTube video with the title "How to remove a Daniel Defense Buttstock" https://www.youtube.com/watch?v=38J0trZR7lo. As can also be seen from the video, it is only with difficulty that an actuating lever of the buttstock can be brought into an open position, in which the buttstock can be removed from the lower receiver part of the firearm.

US2021381799 A1 discloses a further buttstock. A buttstock of such a design is also difficult to adjust.

Accordingly, there is a need for an improved buttstock.

SUMMARY

The object of the present invention was to overcome the disadvantages of the prior art and to provide a buttstock, a firearm fitted with the buttstock and a method for positioning the buttstock by means of which the handling for positioning or removing the buttstock is made easier.

This object is achieved by a device and a method according to the claims.

The invention concerns the design of a buttstock for a firearm. The buttstock comprises:

- a housing comprising
  - a main housing part with a sliding guide for the axially adjustable mounting of the buttstock on a buttstock mount, such as for instance a buffer tube, of a receiver of the firearm,
  - a rear housing part,
  - a housing strut, wherein the housing strut extends between the main housing part and the rear housing part and wherein a clearance is formed between the housing strut, the main housing part and the rear housing part;
- a locking bolt for axially fixing the buttstock on the buttstock mount, wherein a locking bolt mount for mounting the locking bolt is formed in the housing, wherein the locking bolt mount leads into the sliding guide, wherein the locking bolt is displaceable between a locking position, a displacing position and an open position;
- an actuating lever, wherein the actuating lever has a cross pin mount in the form of a slot with a longitudinal extent and is fastened by means of a cross pin on the main housing part pivotably and displaceably along the longitudinal extent of the cross pin mount, wherein the actuating lever has extending from the cross pin mount a first lever arm, which is coupled to the locking bolt and serves for displacing the locking bolt between the locking position, the displacing position and the open position, wherein the actuating lever has extending from the cross pin mount a second lever arm, which has an actuating surface for actuation by a user.

It is also provided that the cross pin is arranged in the main housing part in a region above the clearance and that the actuating surface is accessible from the clearance, wherein the cross pin is arranged closer to the rear housing part than the locking bolt, wherein the actuating lever is in a rearward position in the locking position and in the displacing position of the locking bolt and the actuating lever is in a forward position in the open position, wherein the actuating lever is closer to the rear housing part in the rearward position than in the forward position.

The buttstock according to the invention has the surprising advantage that the arrangement according to the invention of the actuating lever and the coupling according to the invention of the actuating lever to the housing or to the locking bolt has the effect that much easier operation for adjusting the buttstock and at the same time for completely removing the buttstock can be achieved. Although in the prior art there were already some attempts to design the actuating lever in such a way as to make it easier to operate, no indication of the specific embodiment of the buttstock according to the invention can be found in any document.

A further advantage of the specific embodiment according to the invention is the protected arrangement of the actuating lever within the clearance. In the case of such an arrangement, the actuating lever is protected from being unintentionally actuated during use, for example at the shooting range when the weapon is put down on a support, such as for instance a sandbag or the edge of a table. With an open, unprotected arrangement of the actuating lever, unintentional adjustment of the buttstock can occur, and with it restricted operation of the weapon.

An additional advantage of the design according to the invention is the relatively easy operability and low expenditure of force for actuating the actuating lever for removing the buttstock.

It may be provided in particular that a groove which has a stop, at least on the rear side of the groove, is provided on the buttstock mount. It may also be provided that at least two arresting holes are arranged in the groove.

When the locking bolt is in the locking position, it reaches into one of the arresting holes, so that the buttstock is secured against being displaced in the axial direction of the buttstock mount.

When the locking bolt is in the displacing position, it reaches into the groove, but no longer into the arresting holes. The stop serves as a limitation, past which the locking bolt positioned into the displacing position cannot be moved. Consequently, the buttstock can be displaced in relation to the buttstock mount in the longitudinal direction of the buttstock mount, but the buttstock is secured against being removed completely from the buttstock mount.

When the locking bolt is in the open position, it also does not reach into the groove and can be moved beyond the stop. The buttstock can in this case be removed completely from the buttstock mount.

It may also be expedient if the first lever arm is of a fork-shaped form and has a first fork arm and a second fork arm, wherein a first cam, facing the second fork arm, is formed on the first fork arm, and wherein a second cam, facing the first fork arm, is formed on the second fork arm, wherein a first clearance, into which the first cam reaches, and a second clearance, into which the second cam reaches, are formed on the locking bolt. This measure can achieve the effect that the locking bolt can be easily displaced by means of the actuating lever between the locking position, the displacing position and the open position. It may be provided in particular that the clearances or the cams are formed in such a way as to make a displacement of the cams and the clearances in relation to one another in the axial direction possible. Allowing this relative displacement is advantageous in order to allow a relative movement when there is unwanted turning of the actuating lever. In addition, the possibility of the relative displacement has the effect that it can be made possible for the actuating lever to be easily pulled down for transferring the locking bolt into the open position.

It may also be provided that the first cam has a first cam butting surface, which has a convex shaping, and that the second cam has a second cam butting surface, which has a convex shaping, wherein the cam butting surfaces are facing away from the main housing part. This has the advantage that in various pivoting positions of the actuating lever cam butting surfaces formed in such a way can butt flush against counter butting surfaces in the clearances, in order to make jamming-free actuations of the actuating lever possible.

It may additionally be provided that the locking bolt is of a circular-cylindrical form and that the first clearance has a substantially rectangular shaping, which intersects the locking bolt, and that the second clearance has a substantially rectangular shaping, which intersects the locking bolt. This has the advantage that a clearance formed in such a way can be easily pro-duced and in addition can have good functionality in interaction with the cams.

Also advantageous is a specific embodiment according to which it may be provided that a first butting surface is formed on the main housing part, wherein in the locking position of the locking bolt a first lever arm butting surface of the first lever arm butts against the first butting surface and wherein a downwardly offset shoulder with respect to the first butting surface is formed, wherein in the open position of the locking bolt the first lever arm butting surface of the first lever arm butts against the shoulder. This has the advantage that this measure has the effect that it can be made easier for the locking bolt to be kept in the open position. In particular, the formation of the shoulder has the effect that it can be kept in the open position more easily and that this requires less force and can be accomplished with one hand. As a result, it can be made easier for the buttstock to be removed.

According to a development, it is possible that the second lever arm has a second lever arm butting surface, and that a second butting surface is formed on the main housing part, wherein in the displacing position of the locking bolt the second lever arm butting surface butts against the second butting surface, wherein the first lever arm butting surface and the second lever arm butting surface are arranged in relation to one another at a butting surface angle of between 150° and 179°, in particular between 160° and 178°, preferably between 165° and 175°. Particularly with such a design of the buttstock, easy operation of the actuating lever can be achieved. In particular, this measure has the effect that an easy transfer of the locking bolt from the locking position into the displacing position can be achieved. This has the advantage that this measure allows the locking position and the displacing position of the locking bolt to be uniquely defined. Consequently, the locking bolt can be easily positioned in these positions by means of the actuating lever, in order to achieve the most trouble-free possible function of adjusting the buttstock.

It may also be expedient if the longitudinal extent of the cross pin mount is arranged in relation to the second lever arm butting surface at a cross pin angle of between 135° and 179°, in particular between 145° and 170°, preferably between 150° and 160°. Particularly with such a design of the buttstock, easy operation of the actuating lever can be achieved. In particular, this measure has the effect that an easy transfer of the locking bolt from the displacing position into the open position can be achieved.

It may additionally be provided that a bulge is formed on the actuating lever in the region of the cross pin mount and that a depression is formed between the first butting surface and the second butting surface, wherein the bulge is accommodated in the depression. This has the advantage that this measure can achieve the effect that the region of the actuating lever in which the cross pin mount is arranged can have enough stability that the cross pin mount or the slot does not lead to excessive weakening of the actuating lever, whereby possible component failure is impeded as much as possible.

It may also be provided that the cross pin is formed as one part with the housing. This has the advantage that this measure allows a reduction in the complexity when producing the buttstock, whereby the susceptibility of the buttstock to be defective can be reduced. It may be provided in particular that the housing of the buttstock takes the form of an injection-moulded part of plastic, wherein the cross pin takes the form of directly moulded-on, protruding studs.

According to a particular specific embodiment, it is possible that a bevel is formed on the end faces of the cross pin. This has the advantage that this measure allows the actuating lever to be easily joined to the housing, in order to be able to easily produce the buttstock.

According to an advantageous development, it may be provided that a web is formed on the main housing part in the region of the cross pin, and that the actuating lever has a niche, wherein the web is accommodated in the niche. This has the advantage that this measure allows the actuating lever to be positioned on the housing easily and exactly in position. It may be provided in particular that the niche extends over the complete length of the actuating lever, wherein the actuating lever seen in cross section may have a U-shaped shaping.

It may be advantageous in particular if a first gripping tab is formed on the first fork arm, opposite the first cam, and that a second gripping tab is formed on the second fork arm, opposite the second cam. This has the advantage that the actuating lever can be gripped by the gripping tabs, in order to be able to displace the locking bolt from the displacing position into the open position. In particular, the formation of the gripping tab has the effect that it can be kept in the open position more easily and that this requires less force and can be accomplished with one hand. As a result, it can be made easier for the buttstock to be removed.

It may also be provided that the first gripping tab extends up to a first longitudinal end of the first fork arm and that the second gripping tab extends up to a second longitudinal end of the second fork arm. This has the advantage that the actuating lever can be easily gripped at the gripping tabs, in order to be able to displace the locking bolt from the displacing position into the open position.

The invention also concerns the design of a firearm. The firearm comprises:

- a receiver with a buttstock mount, in particular a buffer tube;
- a buttstock, which is coupled to the buttstock mount of the receiver adjustably in the axial direction of the buttstock mount.

The buttstock is formed according to one of the specific embodiments above.

The invention also concerns a method for positioning a buttstock of a firearm in relation to a receiver of the firearm, wherein the method comprises the following method steps:

- providing a firearm according to the specific embodiment above, wherein the locking bolt is spring-loaded in its locking position;
- pressing the actuating surface of the actuating lever for transferring the locking bolt from the locking position into the displacing position;
- displacing the actuating lever from the rearward position into the forward position for transferring the locking bolt from the displacing position into the open position.

It may be provided in particular that the receiver takes the form of a lower receiver.

The buttstock mount may be designed for example as a buffer tube of an AR-15 style firearm or comparable firearms such as the HK416, etc. or as an AR-15 buttstock interface without a buffer function, such as for example in the case of the SIG XN5 or SIG MPX or in the case of the TR3-5 (Kalashnikov).

The buttstock mount may be mounted on a receiver or be formed as one part with it. For example, the buttstock mount may be arranged on a lower receiver, or on another part of the receiver. The receiver may also be formed as one part. In the example of AR-15 style firearms, the buttstock mount may be mounted in the lower receiver.

The terms left, right, above, below, front/forward and rear/rearward always refer to the view of the shooter in the firing direction of the firearm when the firearm is held ready to fire. The firearm may have a centre plane of the weapon, passing through the barrel bore axis and oriented vertically. It may be provided in particular that the centre plane of the weapon forms a plane of symmetry for at least parts of the firearm. As already stated above, in the description and the claims the terms "front/forward", "rear/rearward", "above", "below", "ver-tical/vertically" and so on are used in the common form and with reference to the subject matter in the position of use, in which the axis of the barrel is aligned horizontally and the centre plane of the weapon is aligned vertically. That is to say that, in the case of the firearm, the muzzle of the barrel is at the "front", that the breechblock or slide is moved to the "rear" by the explosion gases, etc. Transverse to a direction means substantially a direction turned by 90° thereto.

BRIEF DESCRIPTION OF THE DRAWINGS

For a better understanding of the invention, it is explained in more detail with reference to the following figures.

They respectively show in a greatly simplified, schematic representation.

DETAILED DESCRIPTION

Figure 1:
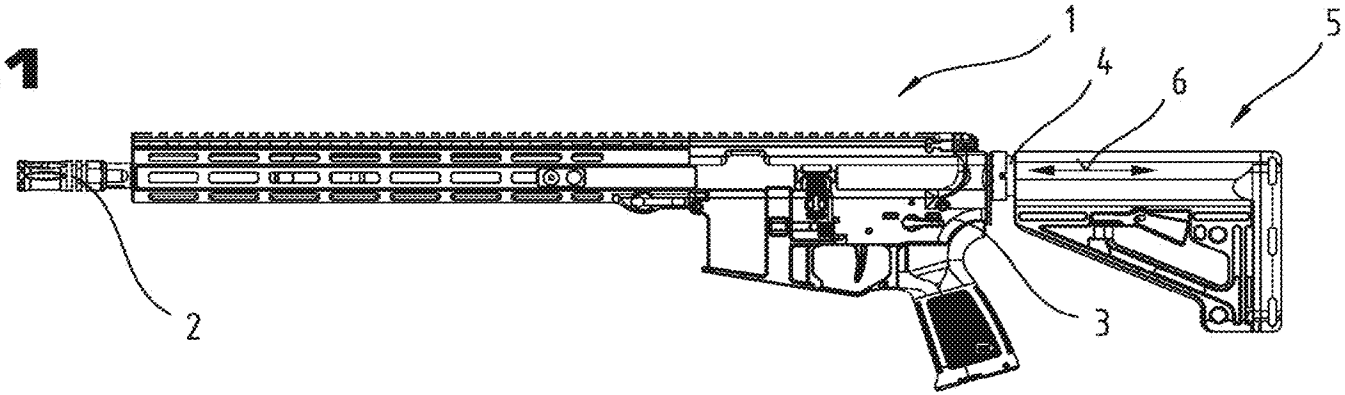
FIG. 1 illustrates a first exemplary embodiment of a firearm in a side view with a forwardly displaced buttstock.

As an introduction, it should be noted that in the differently described embodiments the same parts are provided with the same reference numerals or the same component designations, it being possible for the disclosures contained throughout the description to be applied analogously to the same parts with the same reference numerals or the same component designations. Also the positional indications chosen in the description, such as for example above, below, to the side etc. refer to the figure directly being described or shown, and these positional indications can be transferred analogously to the new position in the case of a change in position.

Figure 2:
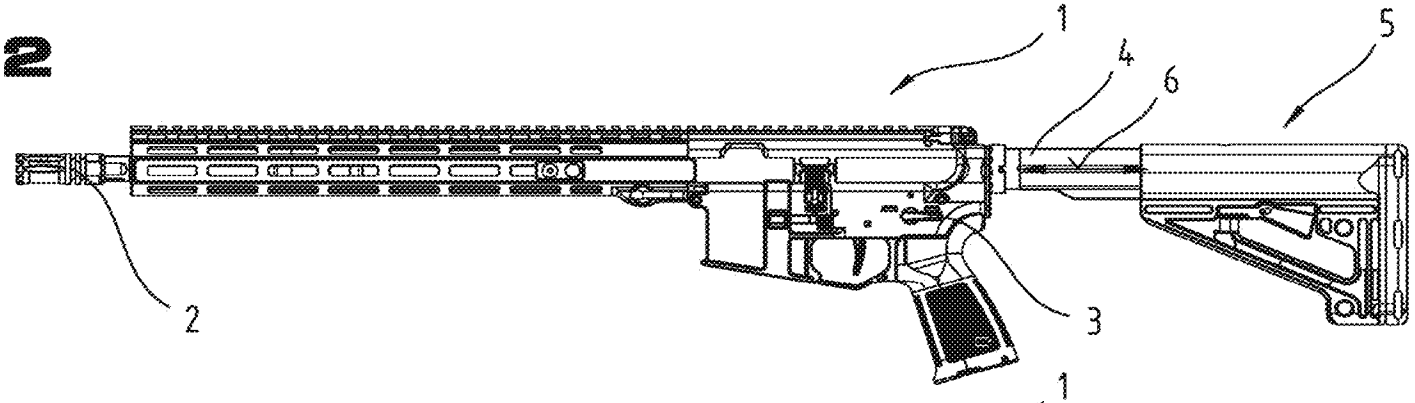
FIG. 2 illustrates the first exemplary embodiment of the firearm in a side view with a rearwardly displaced buttstock.
Figure 3:
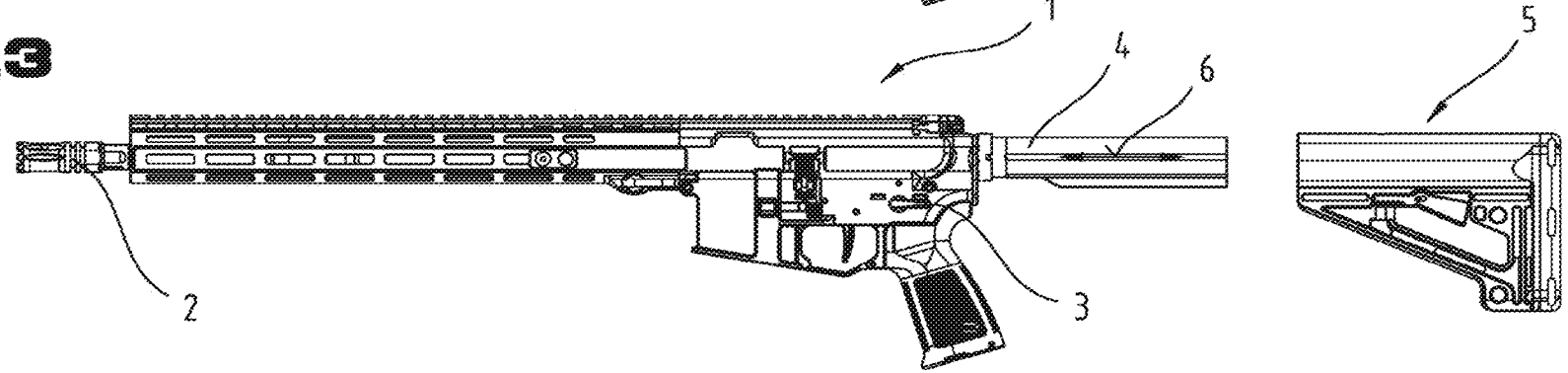
FIG. 3 illustrates the first exemplary embodiment of the firearm in a side view with a removed buttstock.

In FIGS. 1 to 3, a first exemplary embodiment of a firearm 1 is shown in various positions. As can be seen from FIG. 1, it may be provided that the firearm 1 comprises a barrel 2. It may also be provided that the firearm 1 comprises a receiver 3, in particular a lower receiver. A buttstock mount 4, in particular a buffer tube, may be mounted on the receiver 3. It may also be provided that a buttstock 5 is formed. It may be provided in particular that the buttstock 5 is mounted displaceably in an axial direction 6 of the buttstock mount 4 on the latter.

As can be seen from FIGS. 1 and 2, here the buttstock 5 can be fixed in various positions on the buttstock mount 4. Furthermore, as shown in FIG. 3, the buttstock 5 can be removed in its entirety from the buttstock mount 4. The buttstock 5 can assume different positions in the axial direction 6 of the buttstock mount 4 for adaptation to different users.

The adjusting mechanism for adjusting the buttstock 5 in relation to the buttstock mount 4 is also described in detail below on the basis of the following figures.

Figure 4:
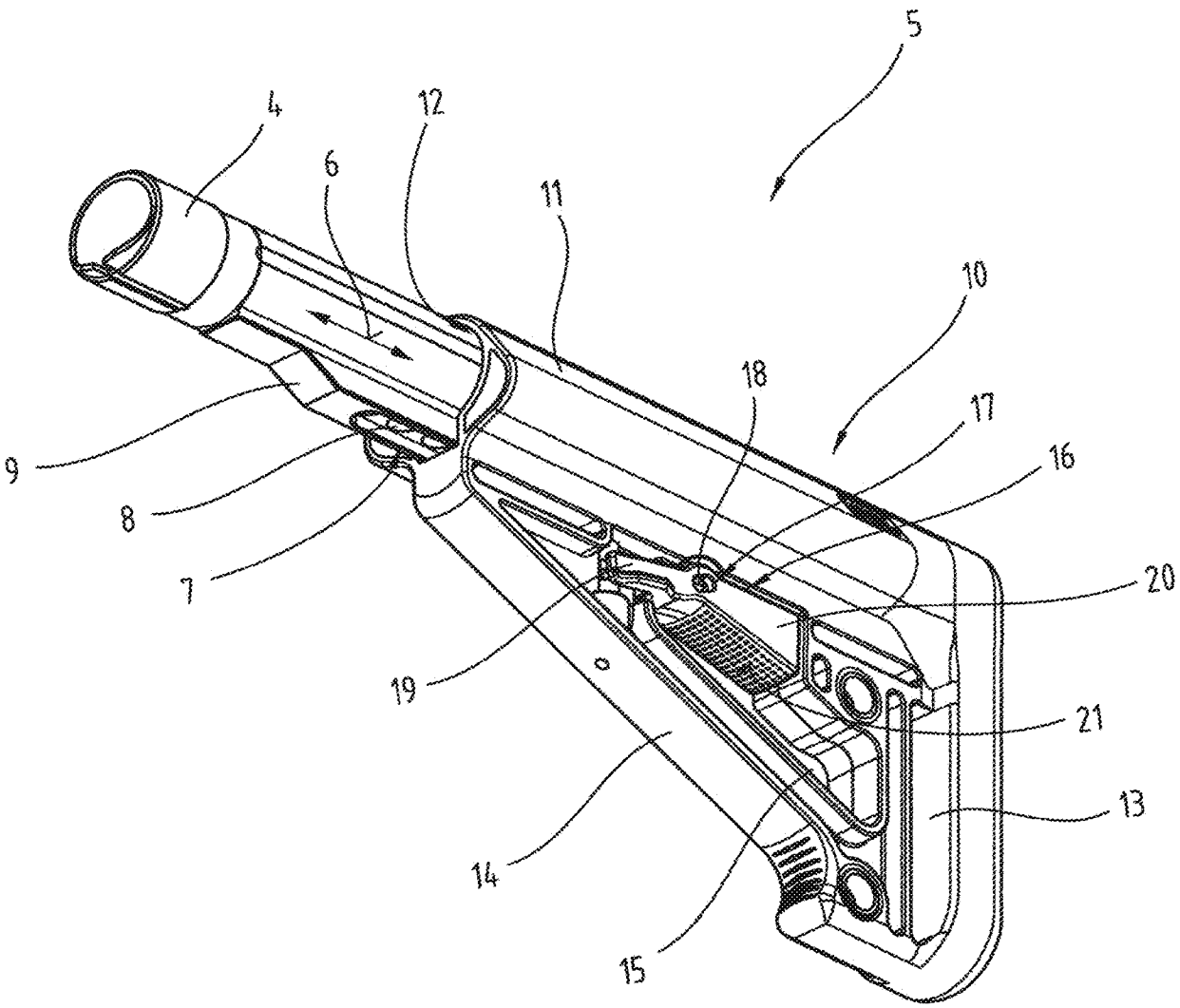
FIG. 4 illustrates a perspective view of a first exemplary embodiment of the buttstock.

FIG. 4 shows a first exemplary embodiment of the buttstock 5, the buttstock mount 4 also being partially shown to illustrate the function. As can be seen from FIG. 4, it may be provided that a groove 7 is formed in the buttstock mount 4. Furthermore, a number of arresting holes 8 may be arranged spaced apart from one another in the axial direction 6. Here, the groove 7 may be arranged in a shaped projection 9. It may be provided in particular that the shaped projection 9 or the groove 7 is formed on an underside of the buttstock mount 4.

It may also be provided that the buttstock 5 comprises a housing 10. The housing 10 may have a main housing part 11. It may be provided in particular that a sliding guide 12, which serves for mounting the buttstock mount 4 displaceably in the axial direction 6, is arranged in the main housing part 11. It may be provided in particular that the sliding guide 12 is adapted to the outer contour of the buttstock mount 4. The shaped projection 9 formed on the buttstock mount 4 or the sliding guide 12 formed diametrically opposite can prevent the buttstock 5 from twisting around the buttstock mount 4. It may be provided in particular that the sliding guide 12 defines a hollow space or a receptacle for the buttstock mount 4.

It may also be provided that the housing 10 comprises a rear housing part 13. The rear housing part 13 may extend downwards at right angles from the main housing part 11. It may also be provided that the housing 10 comprises a housing strut 14. The housing strut 14 may extend between the main housing part 11 and the rear housing part 13. It may be provided in particular that the main housing part 11, the rear housing part 13 and the housing strut 14 give an approximately triangular appearance. It may be provided in particular that the housing strut 14 imparts stability to the main housing part 11 and the rear housing part 13.

As can be seen from FIG. 4, it may be provided that the rear housing part 13 projects downwards with respect to the housing strut 14. The buttstock 5 or the firearm 1 can be gripped more easily by this projection.

It may also be provided that a clearance 15 is formed between the main housing part 11, the rear housing part 13 and the housing strut 14. The clearance 15 may serve the purpose of making it possible for a user to reach with one hand into the clearance 15.

It may be provided in particular that the housing 10 is formed as an injection-moulded part of a plastics material.

For adjusting the buttstock 5 in relation to the buttstock mount 4, an actuating lever 16 may be formed, and may be coupled to a mechanism also described in more detail below for releasing or fixing the buttstock 5.

It may be provided in particular that the actuating lever 16 has a cross pin mount 17, which serves for mounting a cross pin 18. By means of the cross pin mount 17 and the cross pin 18, the actuating lever 16 can be arranged pivotably on the housing 10. It may be provided in particular that the actuating lever 16 is arranged on the main housing part 11 in the region of the clearance 15.

As can also be seen from FIG. 4, it may be provided that the cross pin mount 17 takes the form of a slot, so that the actuating lever 16 can be displaced in the axial direction 6. The cross pin 18 may reach into the cross pin mount 17.

In a first exemplary embodiment, it may be provided that the cross pin 18 is formed as an integral part of the housing 10, in particular is formed on the main housing part 11. The cross pin 18 may take the form here of two simple studs, which are formed as injection-moulded studs on both sides of the housing 10.

In an alternative embodiment variant, it is also conceivable that the cross pin 18 is formed from a different material than the rest of the housing 10 and is injection-moulded in the housing 10. Here, the cross pin 18 may be formed for example from a metal material.

In yet another embodiment, it is also conceivable that the cross pin 18 is mounted removably in a hole in the housing 10. It may be provided here that a press fit is formed between the hole in the housing 10 and the cross pin 18.

It is of course also conceivable that, in an inverse embodiment not shown, the cross pin 18 is arranged on the actuating lever 16 and the cross pin mount 17 takes the form of a slot in the housing 10. Here, the cross pin 18 may have been introduced into the actuating lever 16 by means of a press fit.

It may also be provided that the actuating lever 16 has a first lever arm 19 and a second lever arm 20. The first lever arm 19 may extend forwards from the cross pin 18 and the second lever arm 20 may extend rearwards from the cross pin 18. It may be provided in particular that the second lever arm 20 extends from the cross pin 18 in the direction of the rear housing part 13.

It may also be provided that an actuating surface 21, which serves for pressing by a user, is formed on the second lever arm 20. By pressing the actuating surface 21, the actuating lever 16 can be pivoted about the cross pin 18.

Figure 5:
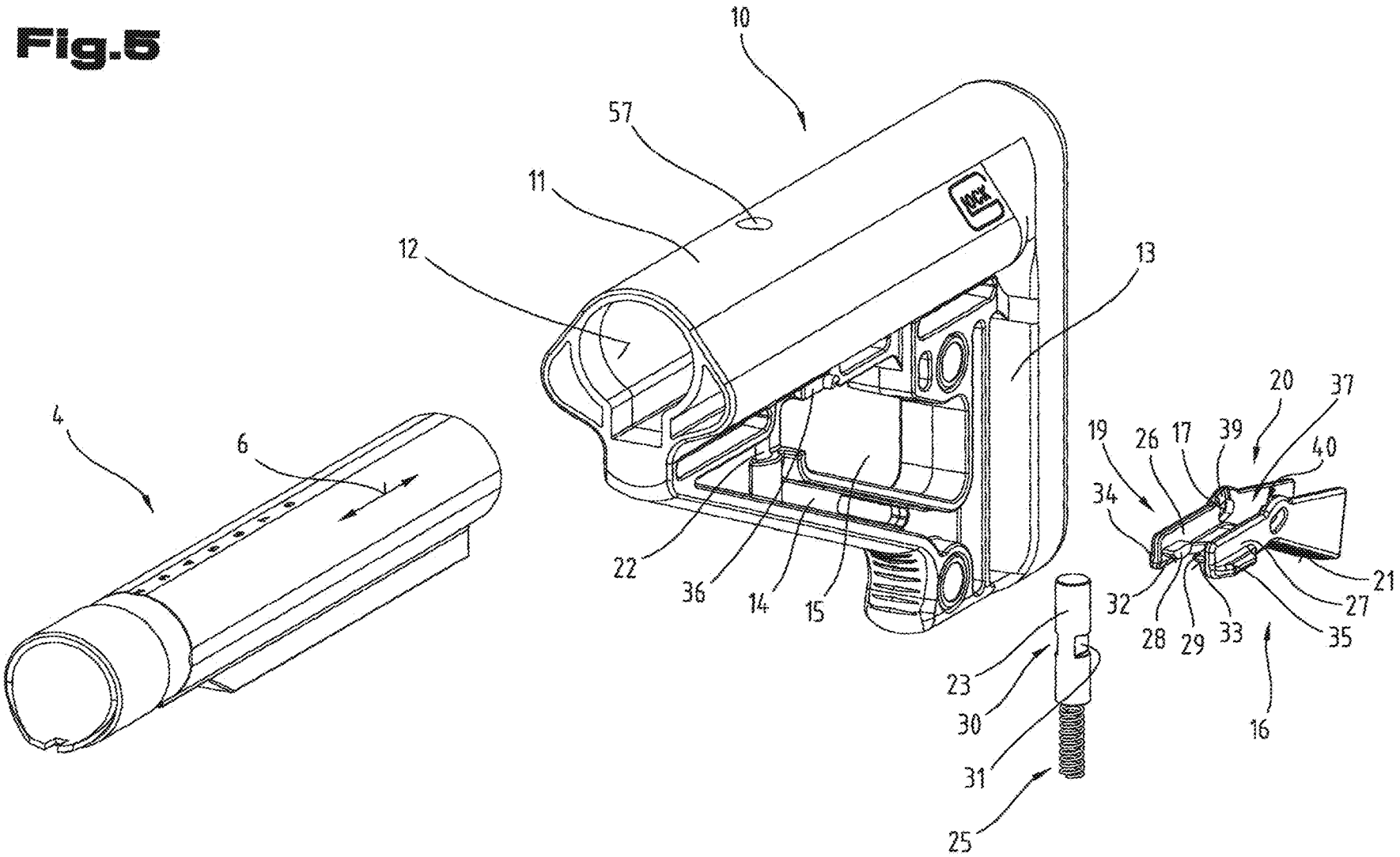
FIG. 5 illustrates an exploded representation of the first exemplary embodiment of the buttstock in a first perspective view.
Figure 6:
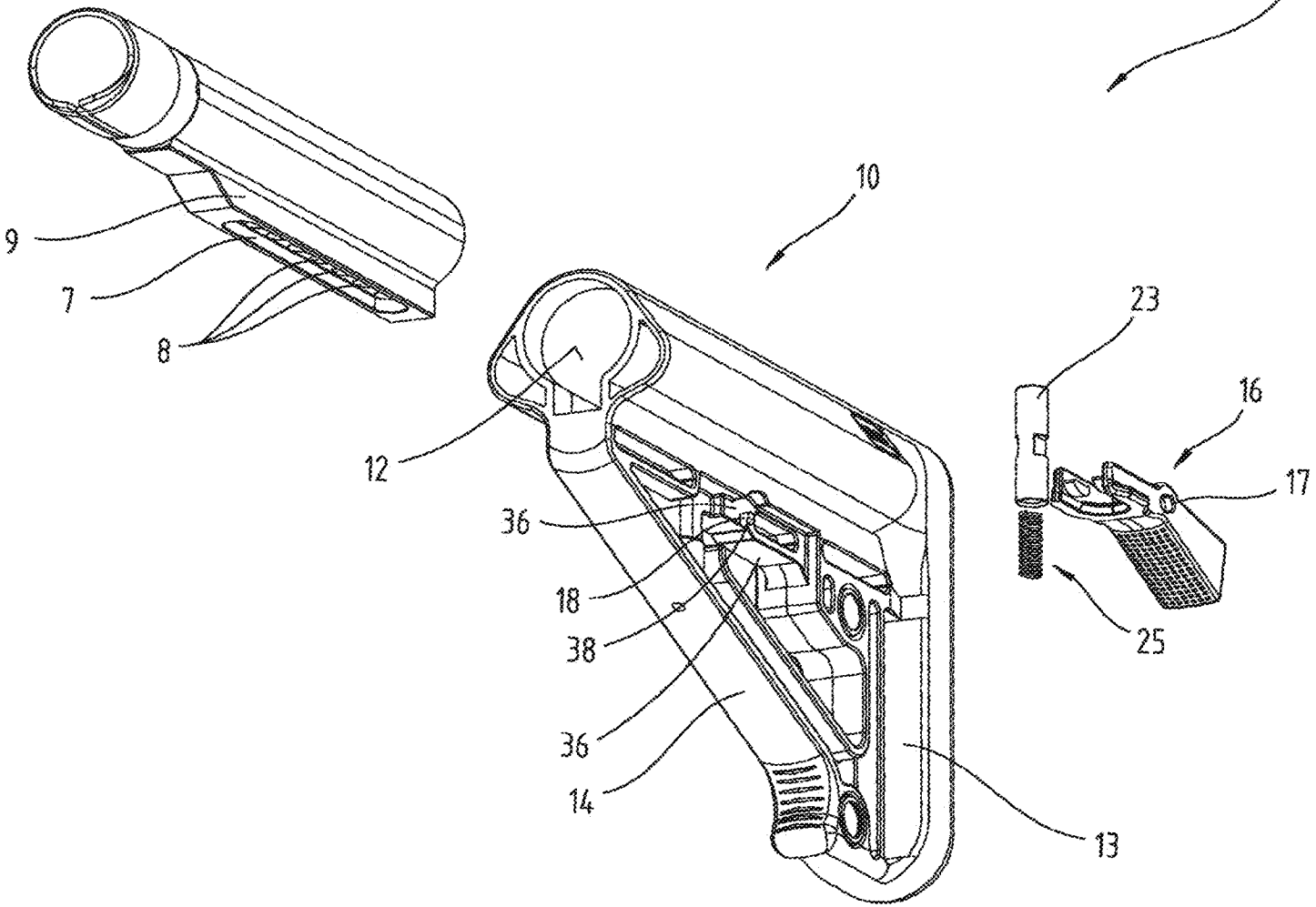
FIG. 6 illustrates an exploded representation of the first exemplary embodiment of the buttstock in a second perspective view.

In FIGS. 5 and 6, the buttstock 5 or its individual parts are respectively shown in a perspective exploded view.

As can be seen particularly well from FIGS. 5 and 6, it may be provided that a locking bolt mount 22, in which a locking bolt 23 is displaceably mounted, is formed in the housing 10. Here, the locking bolt mount 22 may reach into the sliding guide 12 of the main housing part 11. This measure allows the locking bolt 23 to be optionally pushed into the receiving space of the sliding guide 12 from the locking bolt mount 22 or pulled out again.

It may also be provided that the locking bolt mount 22 takes the form of a blind hole, which reaches through the sliding guide 12 into the housing strut 14. It may be provided in particular that in the region of the housing strut 14 the locking bolt mount 22 is delimited by a mount base 24. It may also be provided that a restoring spring 25, which forces the locking bolt 23 into the sliding guide 12, is arranged between the mount base 24 and the locking bolt 23. It may be provided in particular that the locking bolt mount 22 is arranged on an underside of the sliding guide 12.

It may also be provided that an inserting hole 57, through which the locking bolt 23 can be inserted into the locking bolt mount 22, is formed on an upper side of the sliding guide 12 as an extension of the locking bolt mount 22.

It may also be provided that the actuating lever 16 has on the first lever arm 19 a first fork arm 26 and a second fork arm 27, wherein the locking bolt 23 is arranged between the two fork arms 26, 27.

It may be provided in particular that a first cam 28 is arranged on the first fork arm 26 and a second cam 29 is arranged on the second fork arm 27. The first cam 28 and the second cam 29 may be arranged facing one another on the fork arms 26, 27. It may also be provided that a first clearance 30 and a second clearance 31 are arranged in the locking bolt 23. In the assembled state, the first cam 28 may reach into the first clearance 30 and the second cam 29 may reach into the second clearance 31. Consequently, a form-fitting connection can be estab-lished between the locking bolt 23 and the first lever arm 19 of the actuating lever 16.

A first cam butting surface 32, which serves for butting against the first clearance 30, may be formed on the first cam 28. A second cam butting surface 33, which serves for butting against the second clearance 31, may be formed on the second cam 29. The cam butting surfaces 32, 33 may have a convex shaping. It may be provided in particular that the first cam 28 and the second cam 29 are mounted in the first clearance 30 or in the second clearance 31 in such a way that the cams 28, 29 can be displaced in relation to the locking bolt 23 in the axial direction 6 of the buttstock mount 4 or parallel to this axial direction 6. It may be provided in particular that the locking bolt 23 is kept in its position by means of the cams 28, 29, wherein the locking bolt 23 is pressed upwards by means of the restoring spring 25 and wherein the first clearance 30 butts against the first cam butting surface 32 and the second clearance 31 butts against the second cam butting surface 33.

As can also be seen from FIGS. 5 and 6, it may be provided that a web 36 is formed on the main housing part 11. The web 36 may be arranged on an underside of the main housing part 11, and consequently be facing the clearance 15.

It may also be provided that a niche 37 is formed in the actuating lever 16, wherein the niche 37 is formed in such a way that the web 36 can be accommodated in the niche 37. The formation of the niche 37 has the effect that the actuating lever 16 can have a substantially U-shaped cross section. It may be provided in particular that the niche 37 extends over the longitudinal extent of the actuating lever 16. The niche 37 can consequently extend over the first lever arm 19 and the second lever arm 20.

As can be seen particularly well from FIG. 6, it may be provided that the cross pin 18 has a bevel 38 at its ends, wherein the bevel 38 may be of a downwardly tapering form. The bevel 38 may serve the purpose of being able to push the actuating lever 16 onto the main housing part 11 from the bottom upwards during the assembly of the buttstock 5.

As can also be seen from FIG. 5, it may be provided that a first pushing-on clearance 39 and a second pushing-on clearance 40 are formed on the actuating lever 16 in the region of the niche 37. The pushing-on clearances 39, 40 may extend up to the cross pin mount 17. It may be provided in particular that, during the assembly of the buttstock 5, the cross pin 18 is led through in the first pushing-on clearance 39 and in the second pushing-on clearance 40.

Figure 7:
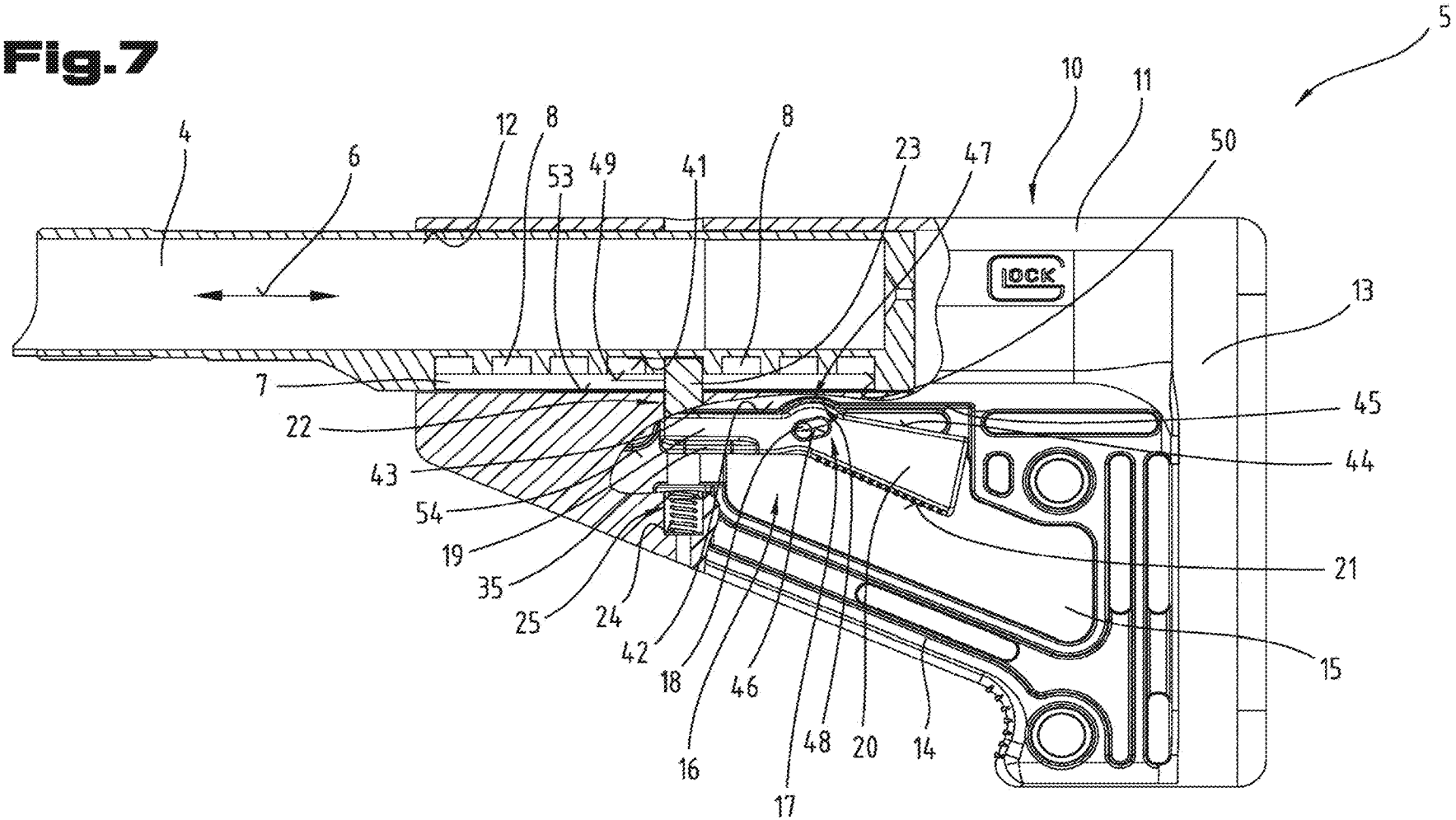
FIG. 7 illustrates a sectional representation of the buttstock with a locking bolt in a locking position.
Figure 8:
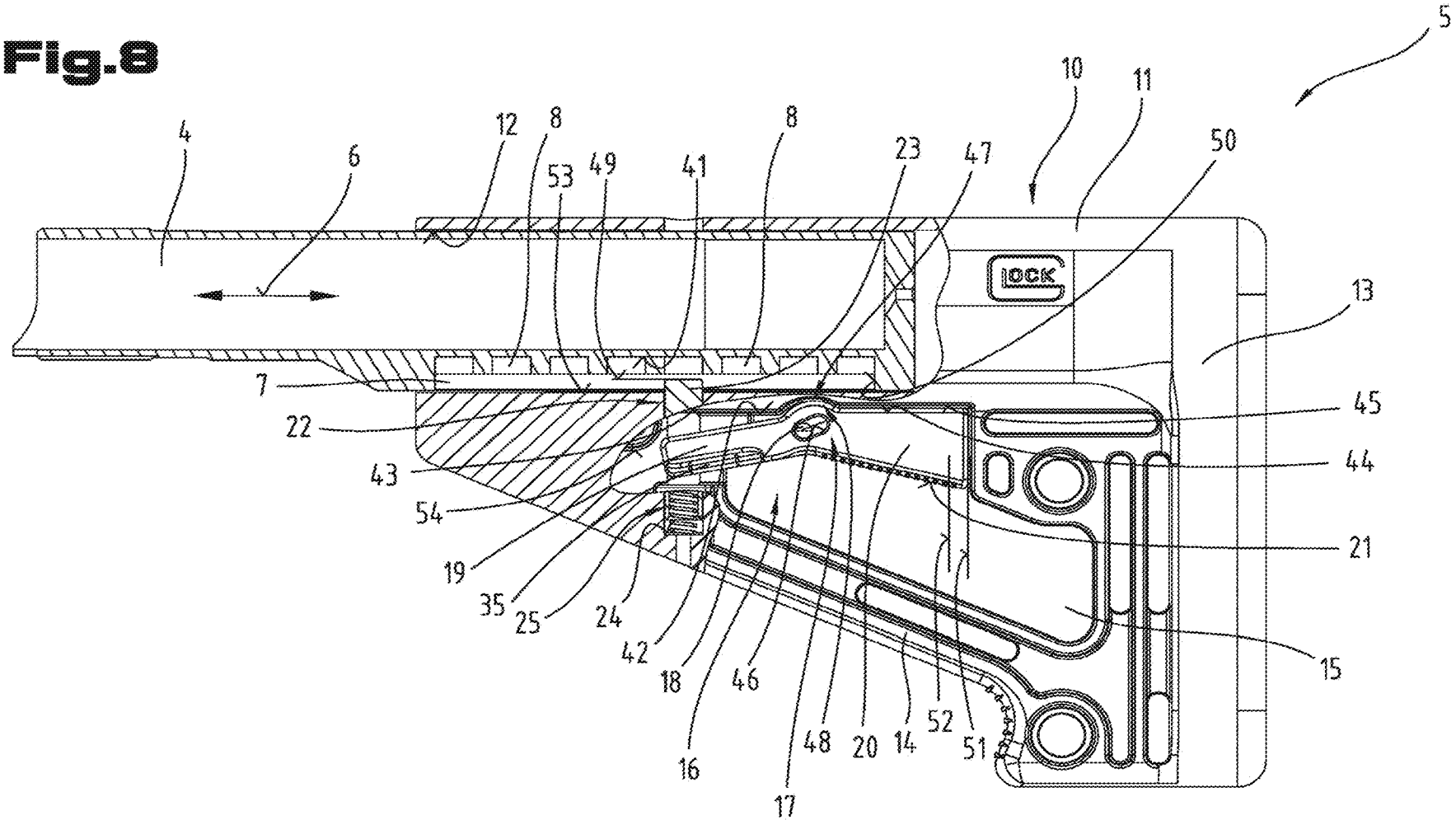
FIG. 8 illustrates a sectional representation of the buttstock with the locking bolt in a displacing position.
Figure 9:
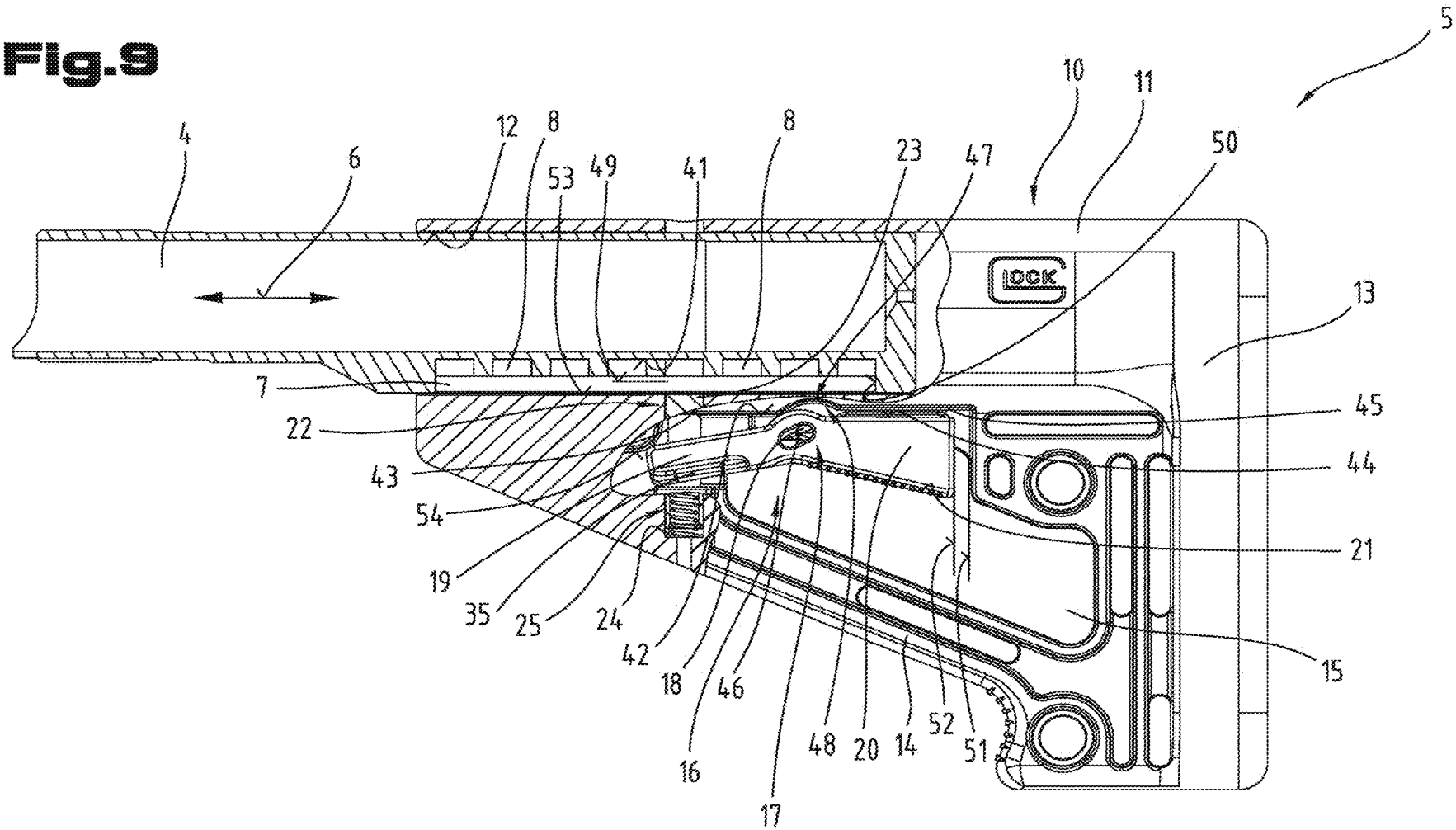
FIG. 9 illustrates a sectional representation of the buttstock with the locking bolt in an open position.

In FIGS. 7 to 9, the buttstock 5 with the buttstock mount 4 is shown in a partially sectional side view, with the same reference numerals or component designations as in the preceding FIGS. 1 to 6 being used again for the same parts. In order to avoid unnecessary repe-titions, reference is made to the detailed description in the preceding FIGS. 1 to 6. Here, the sliding guide 12 has been pushed onto the buttstock mount 4.

In the representation according to FIG. 7, the locking bolt 23 is mounted in one of the arresting holes 8, whereby the buttstock 5 is secured against displacement in the axial direction 6 of the buttstock mount 4. Here, the locking bolt 23 is kept in this position by the spring force of the restoring spring 25. The actuating lever 16 coupled to the locking bolt 23 is likewise in a locking position 41.

As can be seen from FIG. 7, it may be provided that in this position a first lever arm butting surface 42 of the first lever arm 19 butts against a first butting surface 43 of the housing 10.

Here, a second lever arm butting surface 44 of the second lever arm 20 is at a distance from a second butting surface 45 on the housing 10.

In FIG. 7, it can likewise be seen well that the cross pin mount 17 can take the form of a slot and can extend in a longitudinal extent 46.

It may also be provided that the actuating lever 16 has a bulge 47 above the cross pin mount 17. The bulge 47 may be accommodated in a recess 48 of the housing 10. It may be provided in particular that the recess 48 of the housing 10 interrupts the first butting surface 43 and the second butting surface 45.

In the representation according to FIG. 8, the locking bolt 23 is in a displacing position 49. Corresponding thereto, the actuating lever 16 is also in a displacing position. In comparison with the locking position 41, the locking bolt 23 has been displaced downwards in the locking bolt mount 22 counter to the spring force of the restoring spring 25, so that it no longer reaches into the arresting hole 8. Here, the restoring spring 25 has been compressed further. In the displacing position 49, the locking pin 23 also reaches into the groove 7 of the buttstock mount 4, so that it is level with a stop 50 formed at the end of the groove 7.

When the locking bolt 23 is in its displacing position 49, as shown in FIG. 8, the buttstock 5 can be displaced in relation to the buttstock mount 4 in the axial direction 6 of the buttstock mount 4, but cannot be removed completely from the buttstock mount 4 because of the stop 50 or the correspondence of the locking bolt 23 with the stop 50. In this position, the second lever arm butting surface 44 can butt against the second butting surface 45. Here, the actuating lever 16 may be pivoted about a central axis of the cross pin 18 in comparison with the locking position.

Here, the actuating lever 16 may be in a rearward position 51, while the cross pin 18 is in a front region of the cross pin mount 17.

In the representation according to FIG. 9, the locking bolt 23 is in an open position 53. Corresponding thereto, the actuating lever 16 is also in an open position. In the open position 53, the locking bolt 23 has been downwardly displaced to such an extent that it also lies outside the groove 7, and consequently the stop 50 can be displaced beyond the locking bolt 23. As a result, in the open position 53 of the locking bolt 23, the buttstock 5 can be removed completely from the buttstock mount 4.

In the open position, the actuating lever 16 may have been displaced into a forward position 52. Here, the cross pin 18 may have been displaced into the rear region of the cross pin mount 17 in the longitudinal extent 46 of the cross pin mount 17.

It may also be provided that, in the open position according to FIG. 9, the first butting surface 43 is supported on a shoulder 54. Here, the shoulder 54 may be of a downwardly offset form in comparison with the first butting surface 43. The butting of the first lever arm 19 against the shoulder 54 has the advantage that it is easier for the actuating lever 16 to be kept in the open position.

A possible method for positioning the buttstock 5 of the firearm 1 in relation to the receiver 3 of the firearm 1 or in relation to the buttstock mount 4 is now described on the basis of FIGS. 7 to 9.

In a starting situation, the locking bolt 23 may be in its locking position 41, in a way corresponding to the representation according to FIG. 7, and may reach into one of the arresting holes 8, whereby the buttstock 5 is secured in relation to the buttstock mount 4 in the axial direction 6. This position can be reached or maintained by the restoring spring 25.

In a further method step, the user can press the actuating lever 16 on the actuating surface 21 and apply a force to the actuating surface 21, whereby the actuating lever 16 is transferred from the locking position according to FIG. 7 into the displacing position according to FIG. 8. The coupling of the locking bolt 23 to the actuating lever 16 has the effect that, as a result, the locking bolt 23 can also be transferred from its locking position 41 into its displacing position 49 counter to the spring force of the restoring spring 25.

In the displacing position according to FIG. 8, the buttstock 5 can be displaced in relation to the buttstock mount 4 in the axial direction 6. For ending the setting operation and for renewed arresting of the locking bolt 23 in one of the arresting holes 8, the actuating lever 16 can be let go, wherein the locking bolt 23, and with it also the actuating lever 16, are forced into the locking position 41 by the spring force of the restoring spring 25. When the locking bolt 23 coincides correspondingly with one of the further arresting holes 8, the locking bolt 23 can be pushed into the relevant arresting hole 8.

For the complete removal of the buttstock 5 from the buttstock mount 4, the locking bolt 23 can be transferred into its displacing position 49 in the way described above. In a further method step, the actuating lever 16 may be gripped by the gripping tabs 34, 35 and, by manual pulling downwards or obliquely forwards, the actuating lever 16 can be displaced from the rearward position 51 into the forward position 52. As a result, the locking bolt 23 can be displaced into its open position 53. This is made possible particularly well by the formation of the cross pin mount 17 in the form of a slot. This design allows relatively easy operability and low expenditure of force for actuating the actuating lever 16 for removing the buttstock 5 to be achieved.

This measure has the effect that the buttstock 5 can be removed completely from the buttstock mount 4. So when the gripping taps 34, 35 are let go, the locking bolt 23, and coupled thereto the actuating lever 16, can be moved into the locking position 41. This can be performed by the spring force of the restoring spring 25.

In an alternative variant of the method, it is also conceivable that, starting from the rest position in which the locking bolt 23 is in the locking position 41 and the actuating lever 16 is likewise in the locking position, the actuating lever 16 is gripped directly at the gripping tabs 34, 35 and is moved into the displacing position by an initial downward pulling and, directly thereafter, the actuating lever 16 is moved into the open position by further pulling on the gripping tabs 34, 35.

Figure 10:
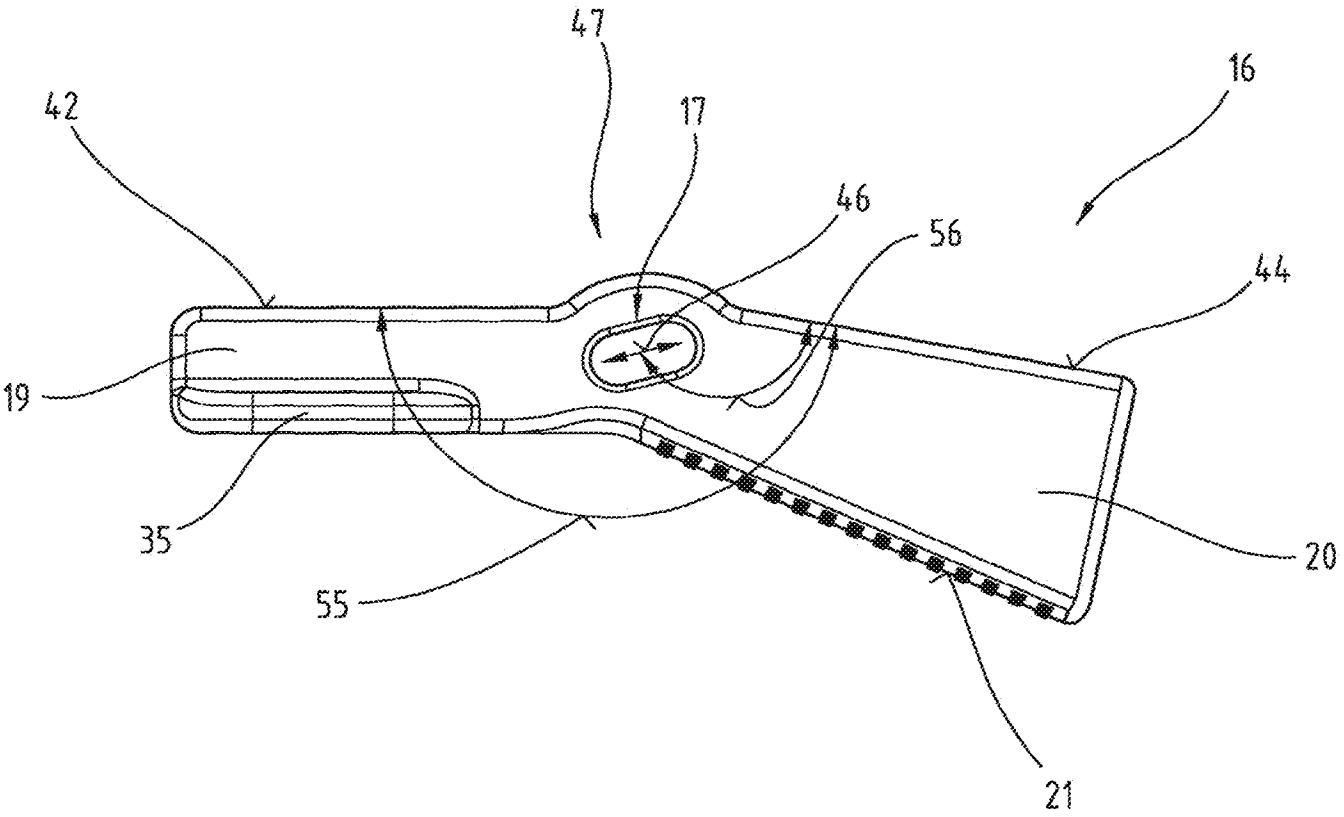
FIG. 10 illustrates a first exemplary embodiment of an actuating lever in a side view.

FIG. 10 shows the actuating lever 16 in a side view. As can be seen from FIG. 10, it may be provided that the first lever arm butting surface 42 and the second lever arm butting surface 44 are arranged at a butting surface angle 55 in relation to one another. Here, the butting surface angle 55 is measured on the underside of the two lever arm butting surfaces 42, 44. It may also be provided that the longitudinal extent 46 of the cross pin mount 17 is arranged at a cross pin angle 56 in relation to the second lever arm butting surface 44. Here, the cross pin angle 56 may likewise be measured on an underside of the second lever arm butting surface 44.

The exemplary embodiments show possible embodiment variants, it being noted at this stage that the invention is not restricted to the embodiment variants thereof specifically represented, but rather that various combinations of the individual embodiment variants with one another are also possible and, on the basis of the teaching for technical action provided by the present invention, this possibility of variation is within the ability of a person skilled in the art working in this technical field.

The scope of protection is determined by the claims. However, the description and the drawings should be used to interpret the claims. Individual features or combinations of features from the different exemplary embodiments shown and described can represent independent inventive solutions per se. The object on which the independent inventive solutions are based can be found in the description.

All of the indications of ranges of values in the present description should be understood as meaning that they include any and all subranges thereof; for example, the indication 1 to 10 should be understood as meaning that all of the subranges on the basis of the lower limit 1 and the upper limit 10 are included, i.e. all of the subranges begin with a lower limit of 1 or greater and end with an upper limit of 10 or less, for example 1 to 1.7, or 3.2 to 8.1, or 5.5 to 10.

For the sake of good order, it should finally be pointed out that, for better understanding of the construction, elements have sometimes been represented not to scale and/or enlarged and/or reduced in size.

The invention claimed is:

1. A buttstock for a firearm, the buttstock comprising:

a housing comprising:

a main housing part with a sliding guide for axially adjustable mounting of the buttstock on a buttstock mount of a receiver of the firearm, wherein the buttstock mount is a buffer tube, a rear housing part, and a housing strut, wherein the housing strut extends between the main housing part and the rear housing part, and wherein a clearance is formed between the housing strut, the main housing part and the rear housing part;

a locking bolt for axially fixing the buttstock on the buttstock mount, wherein a locking bolt mount for mounting the locking bolt is in the housing, wherein the locking bolt mount leads into the sliding guide, and wherein the locking bolt is displaceable between a locking position, a displacing position and an open position; and an actuating lever, wherein the actuating lever has a cross pin mount configured as a slot with a longitudinal extent and is fastened via a cross pin on the main housing part pivotably and displaceably along a longitudinal extent of the cross pin mount, wherein the actuating lever has extending from the cross pin mount a first lever arm, the first lever arm is coupled to the locking bolt and serves for displacing the locking bolt between the locking position, the displacing position and the open position, wherein the actuating lever has extending from the cross pin mount a second lever arm, which has an actuating surface for actuation by a user, wherein the cross pin is arranged in the main housing part in a region above the clearance, and wherein the actuating surface is accessible from the clearance, and wherein the cross pin is arranged closer to the rear housing part than the locking bolt, and wherein the actuating lever is in a rearward position in the locking position and in the displacing position of the locking bolt, and wherein the actuating lever is in a forward position in the open position, and wherein the actuating lever is closer to the rear housing part in the rearward position than in the forward position.

2. The buttstock of claim 1, wherein the first lever arm has a fork-shaped form and has a first fork arm and a second fork arm, and wherein a first cam, facing the second fork arm, is formed on the first fork arm, and wherein a second cam, facing the first fork arm, is formed on the second fork arm, and wherein a first clearance, into which the first cam reaches, and a second clearance, into which the second cam reaches, are formed on the locking bolt.

3. The buttstock of claim 2, wherein the first cam has a first cam butting surface, which has convex shaping, and wherein the second cam has a second cam butting surface, which has convex shaping, and wherein the first and second cam butting surfaces are facing away from the main housing part.

4. The buttstock of claim 2, wherein the locking bolt has a circular-cylindrical form, and wherein the first clearance has a substantially rectangular shaping, which intersects the locking bolt, and wherein the second clearance has a substantially rectangular shaping, which intersects the locking bolt.

5. The buttstock of claim 1, further comprising:

a first butting surface of the main housing part, wherein, when in the locking position of the locking bolt, a first lever arm butting surface of the first lever arm butts against the first butting surface; and a downwardly offset shoulder with respect to the first butting surface, wherein, when in the open position of the locking bolt, the first lever arm butting surface of the first lever arm butts against the shoulder.

6. The buttstock of claim 5, further comprising:

a second lever arm butting surface of the second lever arm; and a second butting surface on the main housing part, wherein, when in the displacing position of the locking bolt, the second lever arm butting surface butts against the second butting surface, and wherein the first lever arm butting surface and the second lever arm butting surface are arranged in relation to one another at a butting surface angle between 150° and 179°, between 160° and 178°, or between 165° and 175°.

7. The buttstock of claim 5, wherein the longitudinal extent of the cross pin mount is arranged in relation to the second lever arm butting surface at a cross pin angle between 135° and 179°, between 145° and 170°, or between 150° and 160°.

8. The buttstock of claim 1, further comprising:

a bulge on the actuating lever in a region of the cross pin mount; and a depression between the first butting surface and the second butting surface, wherein the bulge is accommodated in the depression.

9. The buttstock of claim 1, wherein the cross pin is formed as one part with the housing.

10. The buttstock of claim 9, further comprising a bevel on end faces of the cross pin.

11. The buttstock of claim 1, further comprising:

a web on the main housing part in a region of the cross pin; and a niche (37) of the actuating lever, wherein the web is accommodated in the niche.

12. The buttstock of claim 2 further comprising:

a first gripping tab of the first fork arm, opposite the first cam; and a second gripping tab of the second fork arm, opposite the second cam.

13. The buttstock of claim 12, wherein the first gripping tab extends up to a first longitudinal end of the first fork arm, and wherein the second gripping tab extends up to a second longitudinal end of the second fork arm.

14. A firearm comprising:

a receiver with a buttstock mount, wherein the buttstock mount is a buffer tube;

a buttstock coupled to the buttstock mount of the receiver, wherein the buttstock is coupled adjustably in the axial direction of the buttstock mount, wherein the buttstock comprises:

a housing comprising:

a main housing part with a sliding guide for an axially adjustable mounting of the buttstock on a buttstock mount of a receiver of the firearm, a rear housing part, and a housing strut, wherein the housing strut extends between the main housing part and the rear housing part, and wherein a clearance is formed between the housing strut, the main housing part and the rear housing part;

a locking bolt for axially fixing the buttstock on the buttstock mount, wherein a locking bolt mount for mounting the locking bolt is in the housing, wherein the locking bolt mount leads into the sliding guide, and wherein the locking bolt is displaceable between a locking position, a displacing position and an open position; and an actuating lever, wherein the actuating lever has a cross pin mount configured as a slot with a longitudinal extent and is fastened via a cross pin on the main housing part pivotably and displaceably along a longitudinal extent of the cross pin mount, wherein the actuating lever has extending from the cross pin mount a first lever arm, the first lever arm is coupled to the locking bolt and serves for displacing the locking bolt between the locking position, the displacing position and the open position, and wherein the actuating lever has extending from the cross pin mount a second lever arm, which has an actuating surface for actuation by a user, and wherein the cross pin is arranged in the main housing part in a region above the clearance, and wherein the actuating surface is accessible from the clearance, and wherein the cross pin is arranged closer to the rear housing part than the locking bolt, and wherein the actuating lever is in a rearward position in the locking position and in the displacing position of the locking bolt, and wherein the actuating lever is in a forward position in the open position, and wherein the actuating lever is closer to the rear housing part in the rearward position than in the forward position.

15. The firearm of claim 14 wherein the first lever arm has a fork-shaped form and has a first fork arm and a second fork arm, wherein a first cam, facing the second fork arm, is formed on the first fork arm, and wherein a second cam, facing the first fork arm, is formed on the second fork arm, and wherein a first clearance, into which the first cam reaches, and a second clearance, into which the second cam reaches, are formed on the locking bolt.

16. The firearm of claim 15 wherein the first cam has a first cam butting surface, which has convex shaping, and wherein the second cam has a second cam butting surface, which has convex shaping, and wherein the first and second cam butting surfaces are facing away from the main housing part.

17. The firearm of claim 16 wherein the locking bolt has a circular-cylindrical form, and wherein the first clearance has a substantially rectangular shaping, which intersects the locking bolt, and wherein the second clearance has a substantially rectangular shaping, which intersects the locking bolt.

18. The firearm of claim 14 further comprising:

a first butting surface of the main housing part, wherein, when in the locking position of the locking bolt, a first lever arm butting surface of the first lever arm butts against the first butting surface; and a downwardly offset shoulder with respect to the first butting surface, wherein, when in the open position of the locking bolt, the first lever arm butting surface of the first lever arm butts against the shoulder.

19. The firearm of claim 18 further comprising:

a second lever arm butting surface of the second lever arm; and a second butting surface on the main housing part, wherein, when in the displacing position of the locking bolt, the second lever arm butting surface butts against the second butting surface, and wherein the first lever arm butting surface and the second lever arm butting surface are arranged in relation to one another at a butting surface angle between 150° and 179°, between 160° and 178°, or between 165° and 175°.

20. A method, employing the firearm of claim 14, for positioning the buttstock of the firearm in relation to the receiver of the firearm, the method comprising:

providing the firearm such that the locking bolt is spring-loaded in its locking position;

pressing the actuating surface of the actuating lever for transferring the locking bolt from the locking position into the displacing position; and displacing the actuating lever from the rearward position into the forward position for transferring the locking bolt from the displacing into the open position.

* * * * *